US010772793B2

(12) United States Patent
Paradis

(10) Patent No.: US 10,772,793 B2
(45) Date of Patent: Sep. 15, 2020

(54) MECHANICAL CARDIOPULMONARY RESUSCITATION COMBINING CIRCUMFERENTIAL CONSTRICTION AND ANTEROPOSTERIOR COMPRESSION OF THE CHEST

(71) Applicant: Norman A. Paradis, Putney, VT (US)

(72) Inventor: Norman A. Paradis, Putney, VT (US)

( * ) Notice: Subject to any disclaimer, the term of this patent is extended or adjusted under 35 U.S.C. 154(b) by 1064 days.

(21) Appl. No.: 15/180,964

(22) Filed: Jun. 13, 2016

(65) Prior Publication Data

US 2016/0361228 A1 Dec. 15, 2016

Related U.S. Application Data

(60) Provisional application No. 62/174,839, filed on Jun. 12, 2015.

(51) Int. Cl.
*A61H 31/00* (2006.01)
*A61H 9/00* (2006.01)

(52) U.S. Cl.
CPC ..... *A61H 31/006* (2013.01); *A61H 31/005* (2013.01); *A61H 9/0078* (2013.01); (Continued)

(58) Field of Classification Search
CPC ..... A61H 31/00–008; A61H 9/0078; A61H 9/0092; A61H 11/00–02; A61H 2201/013; A61H 2201/1246; A61H 2205/084
See application file for complete search history.

(56) References Cited

U.S. PATENT DOCUMENTS 2,699,163 A 1/1955 Engstrom
2,899,955 A 8/1959 Huxley, III et al.
(Continued)

FOREIGN PATENT DOCUMENTS

EP 2709581 B1 3/2014
KR 101383051 B1 4/2014
(Continued)

OTHER PUBLICATIONS

Plaisance et al., "Evaluation of an impedance threshold device in patients receiving active compression-decompression cardiopulmonary resuscitation for out of hospital cardiac arrest", Elsevier, Resuscitation 61 (2004) 265-271, www.elsevier.com/locate/resuscitation.

(Continued)

*Primary Examiner* — Rachel T Sippel
(74) *Attorney, Agent, or Firm* — Loginov & Associates, PLLC; William A. Loginov

(57) ABSTRACT

The present invention is a method for improving hemodynamics and clinical outcome of patients suffering cardiac arrest and other low-flow states by combination of circumferential constriction and anteroposterior compression decompression of the chest cardiopulmonary resuscitation. Anteroposterior compression decompression may be provided by a piston mechanism attached to a gantry above the patient. Circumferential constriction may be achieved by inflation of pneumatic bladders or shortening of a band. The on-off sequence and relative force of circumferential constriction and anteroposterior compression decompression may be adjusted so as to improve efficacy.

19 Claims, 2 Drawing Sheets

(52) U.S. Cl.
CPC ..... *A61H 2201/013* (2013.01); *A61H 2201/1246* (2013.01); *A61H 2201/5007* (2013.01); *A61H 2201/5094* (2013.01); *A61H 2205/084* (2013.01)

(56) References Cited

U.S. PATENT DOCUMENTS

| | | | | |
|---|---|---|---|---|
| 3,364,924 | A | 1/1968 | Barkalow | |
| 3,481,327 | A | 12/1969 | Drennen | |
| 3,683,655 | A | 8/1972 | White et al. | |
| 4,198,963 | A | 4/1980 | Barkalow | |
| 4,349,015 | A | 9/1982 | Alferness | |
| 4,397,306 | A | 8/1983 | Weisfeldt | |
| 4,424,806 | A | 1/1984 | Newman et al. | |
| 4,664,098 | A | 5/1987 | Woudenberg et al. | |
| 4,770,164 | A | 9/1988 | Lach et al. | |
| 4,838,263 | A | 6/1989 | Warwick et al. | |
| 4,840,167 | A | 6/1989 | Olsson et al. | |
| 4,928,674 | A | 5/1990 | Halperin et al. | |
| 5,076,259 | A | 12/1991 | Hayek | |
| 5,222,478 | A | 6/1993 | Scarberry et al. | |
| 5,454,779 | A | 10/1995 | Lurie | |
| 5,490,820 | A | 2/1996 | Schock et al. | |
| 5,496,257 | A | 3/1996 | Kelly | |
| 5,743,864 | A | 4/1998 | Baldwin, II | |
| 5,769,800 | A | 6/1998 | Gelfand et al. | |
| 6,171,267 | B1 | 1/2001 | Baldwin, II | |
| 6,174,295 | B1 | 1/2001 | Cantrell | |
| 6,213,960 | B1 | 4/2001 | Sherman | |
| 6,224,562 | B1 | 5/2001 | Lurie | |
| 6,390,996 | B1 | 5/2002 | Halperin | |
| 6,393,316 | B1 | 5/2002 | Gillberg | |
| 6,418,342 | B1 | 7/2002 | Owen | |
| 6,427,685 | B1 | 8/2002 | Ray, II | |
| 6,752,771 | B2 | 6/2004 | Rothman | |
| 6,827,695 | B2 | 12/2004 | Palazzolo | |
| 6,869,409 | B2 | 3/2005 | Rothman et al. | |
| 7,032,596 | B2 | 4/2006 | Thompson | |
| 7,220,235 | B2 | 5/2007 | Geheb | |
| 8,478,401 | B2 | 7/2013 | Freeman | |
| 8,795,208 | B2 | 8/2014 | Walker | |
| 10,245,209 | B2 | 4/2019 | Lurie | |
| 2001/0007928 | A1 | 7/2001 | Hansen | |
| 2002/0026131 | A1 | 2/2002 | Halperin | |
| 2003/0004445 | A1* | 1/2003 | Hall | A61H 9/0078 601/41 |
| 2004/0230140 | A1 | 11/2004 | Steen | |
| 2006/0089574 | A1 | 4/2006 | Paradis | |
| 2007/0010765 | A1 | 1/2007 | Rothman | |
| 2007/0032829 | A1 | 2/2007 | Ostroff | |
| 2007/0060785 | A1 | 3/2007 | Freeman | |
| 2008/0097534 | A1* | 4/2008 | Myklebust | A61H 31/00 607/5 |
| 2008/0275371 | A1 | 11/2008 | Hoffmann | |
| 2012/0016179 | A1* | 1/2012 | Paradis | A61H 9/0078 600/17 |
| 2014/0094724 | A1* | 4/2014 | Freeman | A61H 31/006 601/41 |
| 2014/0155792 | A1* | 6/2014 | Karve | A61H 9/0078 601/41 |
| 2014/0213942 | A1* | 7/2014 | Hanson | A61H 31/005 601/43 |
| 2014/0336546 | A1 | 11/2014 | Chapman | |
| 2014/0358047 | A1* | 12/2014 | Lurie | A61N 1/3987 601/41 |
| 2015/0094624 | A1* | 4/2015 | Illindala | A61H 31/006 601/41 |
| 2015/0265497 | A1 | 9/2015 | Kaufman | |
| 2019/0091099 | A1* | 3/2019 | Nilsson | A61H 31/006 |

FOREIGN PATENT DOCUMENTS

| | | | |
|---|---|---|---|
| WO | 9965560 | A2 | 12/1999 |
| WO | 2010099628 | A1 | 9/2010 |
| WO | 2014051934 | A1 | 4/2014 |
| WO | 2015048347 | A1 | 4/2015 |

OTHER PUBLICATIONS

Liao et al., "Manual versus mechanical cardiopulmonary resuscitation. An experimental study in pigs", BMC Cardiovascular Disorders, Oct. 2010, 10:53, http://www.biomedcentral.com/1471-2261/10/53 (8 pages).

Lurie et a., "Improving active compression-decompression resuscitation with an inspiratory impedance valve", originally published Mar. 15, 1995, https://doi.org/10.1161/01.CIR.91.6.1629, Circulation. 1995; 91:1629-1632.

Lurie et al., "Improving standard cardiopulmonary resuscitation with an inspiratory impedance threshold valve in a porcine model of cardiac arrest", Anesth Analg 2001; 93:649-655.

Lafuente-Lafuente et al., "Active chest compression-decompression for cardiopulmonary resuscitation (Review)," The Cochrane Collaboration, 2009, Issue 3 (40 pages).

Bircher, N., et al, Do Intrathoracic Pressure Fluctuation or Heart Compressions Move Blood During External Cardiopulmonary Resuscitation (CPR)?, Resuscitation Research Center and the Department of Anesthesiology, University of Pittsburgh, ASA Abstract, V53, No. 3, Sep. 1980.

Cohen, Todd J., et al, Active Compression-Decompression, a New Method of Cardiopulmonary Resuscitation, JAMA, Jun. 3, 1992, vol. 267, No. 21, pp. 2916-2923.

Cohen, Todd J., et al, Active Compression-Decompression Resuscitation: A Novel Method of Cardiopulmonary Resuscitation, American Heart Journal, Nov. 1992, pp. 1145-1150.

Halperin, M.D., Henry R., A Preliminary Study of Cardiopulmonary Resuscitation by Circumferential Compression of the Chest with use of a Pneumatic Vest, The New England Journal of Medicine, vol. 329 No. 11, Sep. 9, 1993, pp. 162-768.

McDonald, M.D., John L, Systolic and Mean Arterial Pressures During Manual and Mechanical CPR in Humans, Annals of Emergency Medicine, 11:6 Une 1982, pp. 292-295.

Ralston, Sandra H., Cardiopulmonary Resuscitation with Interposed Abdominal Compression in Dogs, Anesthesia and Analgesia, vol. 61, No. 8, Aug. 1982, pp. 645-651.

Voorhees, PhD, William D. et al, Improved Oxygen Delivery During Cardiopulmonary Resuscitation with Interposed Abdominal Compressions, Annals of Emergency Medicine, 12:3 Mar. 1983, pp. 128-135.

Wolcke, MD., Benno G., et al, Comparison of Standard Cardiopulmonary Resuscitation Versus the Combination of Active Compression-Decompression Cardiopulmonary Resuscitation and an Inspiratory Impedance Threshold Device for Out-of-Hospital Cardiac Arrest, Circulation, 2003, pp. 108, 2201-2205.

Abella, Benjamin S. et al, CPR quality improvement during in-hospital cardiac arrest using a real-time audiovisual feedback system, Resuscitation, 2007, 73, pp. 54-61.

Babbs, MD, Charles F., Preclinical Studies of Abdominal Counterpulsation in CPR, Annals of Emergency Medicine, 13:9 Sep. 1984, pp. 761-763.

Berkowitz, Ivor D., et al, Blood Flow during Cardiopulmonary Resuscitation with Simultaneous Compression and Ventilation in Infant Pigs, Pediatric Research, 1989, vol. 26, No. 6, pp. 558-564.

Haas, Thorsten, et al, Revisiting the cardiac versus thoracic pump mechanism during cardiopulmonary resuscitation, Resuscitation, 58, Nov. 5, 2002, pp. 113-116.

Jenkins, Constance, et al, Effects of the ResQPOD on Kinetics, Hemodynamics of Vasopressin, and Survivability in a Porcine Cardiac Arrest Model, Military Medicine, vol. 180, Sep. 2015, pp. 1011-1016.

Kleinman, Monica E., et al, Part 5: Adult Basic Life Support and Cardiopulmonary Resuscitation Quality: 2015 okmerican Heart

(56) References Cited

OTHER PUBLICATIONS

Association Guidelines Update for Cardiopulmonary Resuscitation, and Emergency Cardiovascular Sare, Circulation, 2015, 132, S414-S435.
Michael, John R., et al, Mechanisms by with epinephrine augments cerebral and myocardial perfusion during ardiopulmonary resuscitation in dogs, Circulation 69, No. 4, 822-834, 1984.
Niemann MD., James T., Cough-CPR, Documentation of systemic perfusion in man and in an experimental model: a window to the mechanism of blood flow in external CPR, Critical Care Medicine, vol. 8, No. 3, pp. 141-146, Mar. 1980.
Paradis M.D., Norman A., Simultaneous Aortic, Jugular Bulb, and Right Atrial Pressures During Cardiopulmonary Resuscitation in Humans, Insights Into Mechanisms, Circulation, vol. 80, No. 2, Aug. 1989.
Plaisance, M.D., Patrick, A Comparison of Standard Cardiopulmonary Resuscitation and Active Compression-Decompression Resuscitation for Out-of-Hospital Cardiac Arrest, New England Journal of Medicine, vol. 341, No. 8, Aug. 19, 1999, pp. 569-575.
Segal, M.D., PhD, Nicolas, Intermittent Positive-Pressure Ventilation, Chest Compression Synchronized Ventilation, Bilevel Ventilation, Continuous Chest Compression, Active Compression Decompression, and Impedance Threshold Device—The Complexity of Ventilation During Cardiopulmonary Resuscitation, Critical Care Medicine, Feb. 2014, vol. 42, No. 2, pp. 480-481.
Wang, M.D., Chih-Hung, et al, Active Compression-Decompression Resuscitation and Impedance Threshold Device for Out-of-Hospital Cardiac Arrest: A Systematic Review and Metaanalysis of Randomized Controlled Trials, Critical Sare Medicine, Apr. 2015, vol. 43, No. 4, pp. 889-896.
Weisfeldt, M.D., M.L., et al, Increased intrathoracic pressure-no. direct heart compression-causes the rise in ntrathoracic vascular pressures during CPR in dogs and pigs, Critical Care Medicine, pp. 377-378, May 1981.
Yeung, J., et al, The use of CPR feedback/prompt devices during training and CPR performance: A systematic -eview, Resuscitation, 80, pp. 743-751, 2009.
Yang, Z., et al. A tourniquet assisted cardiopulmonary resuscitation augments myocardial perfusion in a porcine model of cardiac arrest, Resuscitation 86 (2015) 49-53.
Qvigstad et al., "Clinical pilot study of different hand positions during manual chest compressions monitored with capnography", Resuscitation 84 (2013) 1203-1207, www.elsevier.com/locate/resuscitation.
Aufderheide, T. P., et al. "Clinical evaluation of an inspiratory impedance threshold device during standard cardiopulmonary resuscitation in patients with out-of-hospital cardiac arrest." Crit Care Med. 33.4 (2005): 734-40.
Barkalow, B. H. "Comparison of miniaturized pneumatic chest compressor to Thumper." Resuscitation 79.3 (2008): 609.
Halperin, H. R., et al. "Cardiopulmonary resuscitation with a novel chest compression device in a porcine model of cardiac arrest: improved hemodynamics and mechanisms." J.Am.Coll.Cardiol. 44.11 (2004): 2214-20.
Ong, M. E., et al. "Use of an automated, load-distributing band chest compression device for out-of-hospital cardiac arrest resuscitation." JAMA 295.22 (2006): 2629-37.
Paradis, N. A., et al. "Coronary perfusion pressure during external chest compression in pseudo-EMD, comparison of systolic versus diastolic synchronization." Resuscitation 83.10 (2012): 1287-91.
Plaisance, P., et al. "Use of an inspiratory impedance threshold device on a facemask and endotracheal tube to reduce intrathoracic pressures during the decompression phase of active compression-decompression cardiopulmonary resuscitation." Crit Care Med. 33.5 (2005): 990-94.
Rudikoff, M. T., et al. "Mechanisms of Blood Flow During Cardiopulmonary Resuscitation." Circulation 61 (1980): 345-52.
Lurie, K.G., Improving active compression-decompression cardiopulmonary resuscitation with an inspiratory impedance value, Abstract Circulation 1995; 91/6 (1 page abstract).
Sanders AB, Kern KB, Ewy GA, Atlas M, Bailey L. "Improved resuscitation from cardiac arrest with open-chest massage". Ann Emerg Med 1984; 13(9 Pt 1):672-675.
Stephenson HE, Corsan Reed L, Hinton JW. "Some Common Denominators in 1200 cases of cardiac arrest". Ann Surg 1953; 137:731-744.
Shinar Z, Bellezzo J, Paradis N et al. "Emergency department initiation of cardiopulmonary bypass: a case report and review of the literature". J Emerg Med 2012; 43(1):83-86.
Shan PS, McNally B, Tang F, Kellermann A. "Recent trends in survival from out-of-hospital cardiac arrest in the United States". Circ 2014; 130(21):1876-1882.
Cave DM, Gazmuri RJ, Otto CW et al. "Part 7: CPR techniques and devices: 2010 American Heart Association Guidelines for Cardiopulmonary Resuscitation and Emergency Cardiovascular Care". Circ 2010; 122(18 Suppl 3): S720-S728.
Hostler D, Everson-Stewart S, Rea TD et al. "Effect of real-time feedback during cardiopulmonary resuscitation outside hospital: prospective, cluster-randomised trial". BMJ 2011; 342:d512.
Stiell IG, Nichol G, Leroux BG et al. "Early versus later rhythm analysis in patients with out-of-hospital cardiac arrest". N Engl J Med 2011; 365(9):787-797.
Hallstrom A, Rea TD, Sayre MR et al. "Manual chest compression vs use of an automated chest compression device during resuscitation following out-of-hospital cardiac arrest: a randomized trial". JAMA 2006; 295(22):2620-2628.
Rubertsson S, Lindgren E, Smekal D et al. "Mechanical chest compressions and simultaneous defibrillation vs conventional cardiopulmonary resuscitation in out-of-hospital cardiac arrest: the LINC randomized trial". JAMA 2014; 311(1):53-61.
Wik L, Olsen JA, Persse D et al. "Manual vs. integrated automatic load-distributing band CPR with equal survival after out of hospital cardiac arrest. The randomized CIRC trial". Resuscitation 2014; 85(6):741-748.
Esibov A, Banville I, Chapman FW, Boomars R, Box M, Rubertsson S. "Mechanical chest compressions improved aspects of CPR in the LINC trial". Resuscitation 2015; 91:116-121.
Plaisance P, Lurie KG, Payen D. "Inspiratory impedance during active compression-decompression cardiopulmonary resuscitation: a randomized evaluation in patients in cardiac arrest". Circ 2000; 101(9):989-994.
Neumann T, Gruenewald M, Lauenstein C, Drews T, Iden T, Meybohm P. "Hands-on defibrillation has the potential to improve the quality of cardiopulmonary resuscitation and is safe for rescuers—a preclinical study". J Am Heart Assoc 2012; 1(5):e001313.
Ong ME, Annathurai A, Shahidah A et al. "Cardiopulmonary resuscitation interruptions with use of a load-distributing band device during emergency department cardiac arrest". Ann Emerg Med 2010; 56(3):233-241.
Paradis, Norman A., et al, Cardiac Arrest, The Science and Practice of Resuscitation Medicine, 2nd edition, Cambridge University Press 2007.
Deakin, C. D., R. M. McLaren, G. W. Petley, F. Clewlow, and M. J. Dalrymple-Hay. 1998. 'Effects of positive end-expiratory pressure on transthoracic impedance—implications for defibrillation', Resuscitation, 37: 9-12.
Ewy, G.A., D.A. Hellman, S. McClung, and D. Taren. 1980. 'Influence of ventilation phase on transthoracic impedance and defibrillation effectiveness', Crit. Care Med, 8: 164-66.
Kerber, R. E., J. D. Bourland, M. J. Kallok, P. Hite, B. Pritchard, F. Charbonnier, C. Birkett, K. Fox-Eastham, and R. A. Kieso. 1990. 'Transthoracic defibrillation using sequential and simultaneous dual shock pathways: experimental studies', Pacing Clin Electrophysiol, 13: 207-17.
Kerber, R. E., J. Grayzel, R. Hoyt, M. Marcus, and J. Kennedy. 1981. 'Transthoracic resistance in human defibrillation. Influence of body weight, chest size, serial shocks, paddle size and paddle contact pressure', Circulation, 63: 676-82.
Kerber, R.E., K.T. Spencer, M.J. Kallok, C. Birkett, R. Smith, D. Yoerger, and R.A. Kieso. 1994. 'Overlapping sequential pulses. A new waveform for transthoracic defibrillation', Circ, 89: 2369-79.
Kirchhof, P., L. Eckardt, P. Loh, K. Weber, R. J. Fischer, K. H. Seidl, D. Bocker, G. Breithardt, W. Haverkamp, and M. Borggrefe. 2002.

(56) References Cited

OTHER PUBLICATIONS

'Anterior-posterior versus anterior-lateral electrode positions for external cardioversion of atrial fibrillation: a randomised trial', Lancet, 360: 1275-9.

Li, Y., H. Wang, J. H. Cho, W. Quan, G. Freeman, J. Bisera, M. H. Weil, and W. Tang. 2010. 'Defibrillation delivered during the upstroke phase of manual chest compression improves shock success', Crit Care Med, 38: 910-5.

Sanders, A.B., K.B. Kern, C.W. Otto, M.M. Milander, and G.A. Ewy. 1989. 'End-tidal carbon dioxide monitoring during cardiopulmonary resuscitation. A prognostic indicator for survival.', JAMA, 262: 1347-51.

Xie, Z., Q. Yang, M. Li, Z. Huang, Y. Wang, Q. Ling, W. Tang, and Z. Yang. 2018. 'Amplitude screening improves performance of AMSA method for predicting success of defibrillation in swine model', Am J Emerg Med.

Zoll, P. M., A. J. Linenthal, W. Gibson, M. H. Paul, and L. R. Norman. 1956. 'Termination of ventricular fibrillation in man by externally applied electric countershock', N Engl J Med, 254: 727-32.

Beck, C. S., E. C. Weckesser, and F. M. Barry. 1956. 'Fatal heart attack and successful defibrillation; new concepts in coronary artery disease', J Am Med Assoc, 161: 434-6.

Ramirez et al., "Effect of Applying Force to Self-Adhesive Electrodes on Transthoracic Impedance: Implications for Electrical Cardioversion", PACE, vol. 39, Oct. 2016, pp. 1141-1147.

Cabanas, J. G., J. B. Myers, J. G. Williams, V. J. De Maio, and M. W. Bachman. 2015. 'Double Sequential External Defibrillation in Out-of-Hospital Refractory Ventricular Fibrillation: A Report of Ten Cases', Prehosp Emerg Care, 19: 126-30.

Kouwenhoven, W.B Closed-Chest Cardiac Massage, JAMA, Jul. 9, 1960, vol. 173, No. 10, pp. 1064-1067.

Arntz, H.R., et al. Phased Chest and Abdominal Compression-Decompression Versus Conventional Cardiopulmonary Resuscitation in Out-of-Hospital Cardiac Arrest, American Heart Association, Inc., Aug. 14, 2001, pp. 768-772.

* cited by examiner 1
2
3
4
5
6
7
8
9
10
11
14
15
16
Airway Obstruction
Phasic Abdominal Compression and Decompression

MECHANICAL CARDIOPULMONARY RESUSCITATION COMBINING CIRCUMFERENTIAL CONSTRICTION AND ANTEROPOSTERIOR COMPRESSION OF THE CHEST

FIELD OF THE INVENTION

The invention disclosed herein relates in general to the field of medical devices used for cardiopulmonary resuscitation (CPR) of patients suffering cardiac arrest or shock, and more particularly, to devices that provide or enhance hemodynamics during CPR.

BACKGROUND OF THE INVENTION

It is possible to induce forward blood flow to during cardiac arrest by application of external force to the thorax. (Kouwenhoven, Jude, and Knickerbocker 1064-67) Most commonly, this has been achieved by providing anteroposterior compression of the mid-chest in the area of the sternum, either manually or mechanically with a piston like mechanism.

The specific mechanisms by which external chest compression achieves forward blood flow remains unclear. Two competing theories have been proposed, the cardiac pump mechanism and the thoracic pump mechanism. It is generally believed that anteroposterior compression of the sternum achieves forward blood flow principally through the cardiac pump mechanism, (Rudikoff et al. 345-52) and that circumferential constriction CPR functions through the thoracic pump. (Niemann et al. 141-46)

The failure to differentiate between these two theories may reflect the possibility that both mechanisms can contribute to forward blood flow. Either the cardiac or thoracic mechanism may be more or less predominant in any given patient depending on their body habitus and individual physiology.

It has been demonstrated that, compared to classical anteroposterior compression, circumferential constriction may be associated with higher intrathoracic pressure changes, greater blood flow, and increased rates of return of spontaneous circulation. (Halperin et al. 2214-20) Typically, such constriction is generally achieved by inflation of a circumferential pneumatic bladder, or semi-circumferentially with a band. (Halperin et al. 2214-20)

The efficacy of anteroposterior compression may be improved by the addition of forceful decompression during the upstroke of the piston. (Plaisance, Lurie, and Payen 989-94) Such active decompression requires attachment of the piston device to the chest. Typically, this is achieved by use of a suction cup device at the end of the piston.

The improvement in hemodynamics associated with active decompression may be mechanistically mediated by creation of increased negative intrathoracic pressure during the decompression phase of CPR, with resulting enhancement of venous return. Additional enhancement of negative intrathoracic pressure and venous return may be achieved by briefly obstructing the airway during the decompression release phase. (Aufderheide et al. 734-40; Plaisance et al. 990-94) Typically, this is achieved through utilization of a cracking valve mechanism called an impedance threshold device.

Although circumferential constriction devices may have advantages over anteroposterior compression devices, they do not allow for active decompression or optimize airway impedance threshold devices.

Additional interventions that may improve either circumferential constriction or anteroposterior compression of the chest include adjunctive therapy with pressor drugs, techniques that actively compress or decompress the abdomen, (Ralston, Babbs, and Niebauer 645-51) techniques that synchronize components with residual cardiac function, (Paradis et al. 1287-91) among others.

Since its first description, external chest compression as a therapy for cardiac arrest, and in particular sudden death, has been extensively studied, and numerous refinements have occurred. (CARDIAC ARREST—The Science and Practice of Resuscitation Medicine). Despite this significant effort, a large majority of patients suffering sudden death will not be successfully resuscitated to discharge from the hospital capable of independent function. This is even true for patients whose cardiac arrest occurs within the hospital and who receive immediate therapy. The inability of medical science to improve the efficacy of resuscitative treatment is one of the great enigmas in modern medicine. (Paradis 97-99)

From its inception, mechanical CPR has been bifurcated into devices that provide anteroposterior compression of the sternum, (Barkalow 509) and devices that utilize circumferential constriction for all or a portion of the chest. (Ong et al. 2629-37) Prior to this disclosure, it has not been appreciated that a more effective method might incorporate a combination of anteroposterior compression of the sternum and circumferential constriction of the remainder of the chest. Such a method would engage both the cardiac pump and thoracic pump hemodynamic mechanisms. The failure to combine these differing approaches may underlie the inability to improve the efficacy of cardiopulmonary resuscitation.

DESCRIPTION OF THE RELATED ART

Devices for providing anteroposterior compression CPR are well known. (McDonald 292-95) (Barkalow 509) Generally, these are piston based devices, with the piston held in position anterior to the patient by a structural arm or arch that acts like a gantry.

Devices for providing circumferential and partial circumferential constriction CPR are well known. (Halperin et al. 762-68) Generally, these incorporate either a band around the front and sides of the patient, or a pneumatic bladder with a constricting outer circumference. In either case, force is applied to the thorax in a circumferential or semi-circumferential manner.

Devices for providing forceful anteroposterior decompression are well known. (Cohen et al. 2916-23)

Devices to enhance negative intrathoracic pressure and venous return are well known. (Plaisance, Lurie, and Payen 989-94).

There do exist devices (US20070010765 A1) that are circumferential or semi-circumferential and that incorporate a bladder anterior to the patient such that a portion of the circumferential force may create some anteroposterior compression. However, this effect is passive and is likely not associated with greater force in the anteroposterior compression vector than in any other of the radial circumferential constriction vectors.

Previous to this disclosure, it has not been appreciated that a device combining anteroposterior compression and circumferential constriction may provide enhanced hemodynamics and clinical efficacy. Such an approach is absent from the medical and intellectual property literature. Additionally absent are any of the specific relationships between the circumferential constriction and anteroposterior compression mechanism's that may optimize efficacy.

SUMMARY OF THE INVENTION

The present invention is a method for improving CPR hemodynamics and clinical outcome of patients suffering cardiac arrest and other low-flow states by combination of circumferential constriction and anteroposterior compression of the chest. The efficacy of the method may be further enhanced by providing active decompression of the chest and full or partial obstruction of the airway during portions of decompression.

The component providing anteroposterior compression of the precordium is a powered piston mechanism attached to a gantry above the patient.

Circumferential constriction of the chest may be achieved in any number of ways including, but not limited to, inflation of a pneumatic device, inflation of a series of pneumatic chambers, shortening of a band device, or a combination of pneumatic chambers and inflexible bands.

The circumferential constriction and anteroposterior compression of the chest may be simultaneous or in a fixed phasic relationship that is not simultaneous. Such a system allows optimization of hemodynamics by variance of the timing and force of each component within each on-off CPR cycle.

The component performing anteroposterior compression of the chest may be attached to the component providing circumferential constriction. As such, they may share force. Alternatively, force may be applied preferentially to one of the two components. In a particular embodiment, the force and movement applied to sternal structures by the anteroposterior compression mechanism may be greater than the force applied elsewhere to the chest by the circumferential constriction mechanism.

In certain embodiments, a mechanism attaches the anteroposterior compression mechanism to the patient's anterior chest for provision of forceful anteroposterior decompression. Such mechanism may be a suction cup attached to the patient side of the piston, or even incorporated into the piston itself.

Generally, it is anticipated the mechanical or pneumatic force for circumferential constriction and anteroposterior compression of the chest will be provided by electrical, mechanical or pneumatic subsystems alone or in combination.

The circumferential or semi-circumferential constriction may be provided by a band alone, a band that has inflatable pneumatic chambers on all or portion of its inner circumference, a circumferential pneumatic bladder or series of bladders, or a combination of pneumatic platters and belts.

Of particular significance, the invention allows application of differential force to one portion of the chest compared to another. This would result in differing portions to be compressed or constricted further toward the center of the patient's chest. In a particular embodiment, 1) the circumferential constriction mechanism and the anteroposterior compression mechanism may both initiate simultaneously, 2) the circumferential constriction mechanism would complete its constriction before the anteroposterior compression mechanism, 3) and the anteroposterior compression would continue longer with greater force so as to move the sternal structures closer to the center of the patient's chest than other portions of the chest.

DETAILED DESCRIPTION

Figure 1:
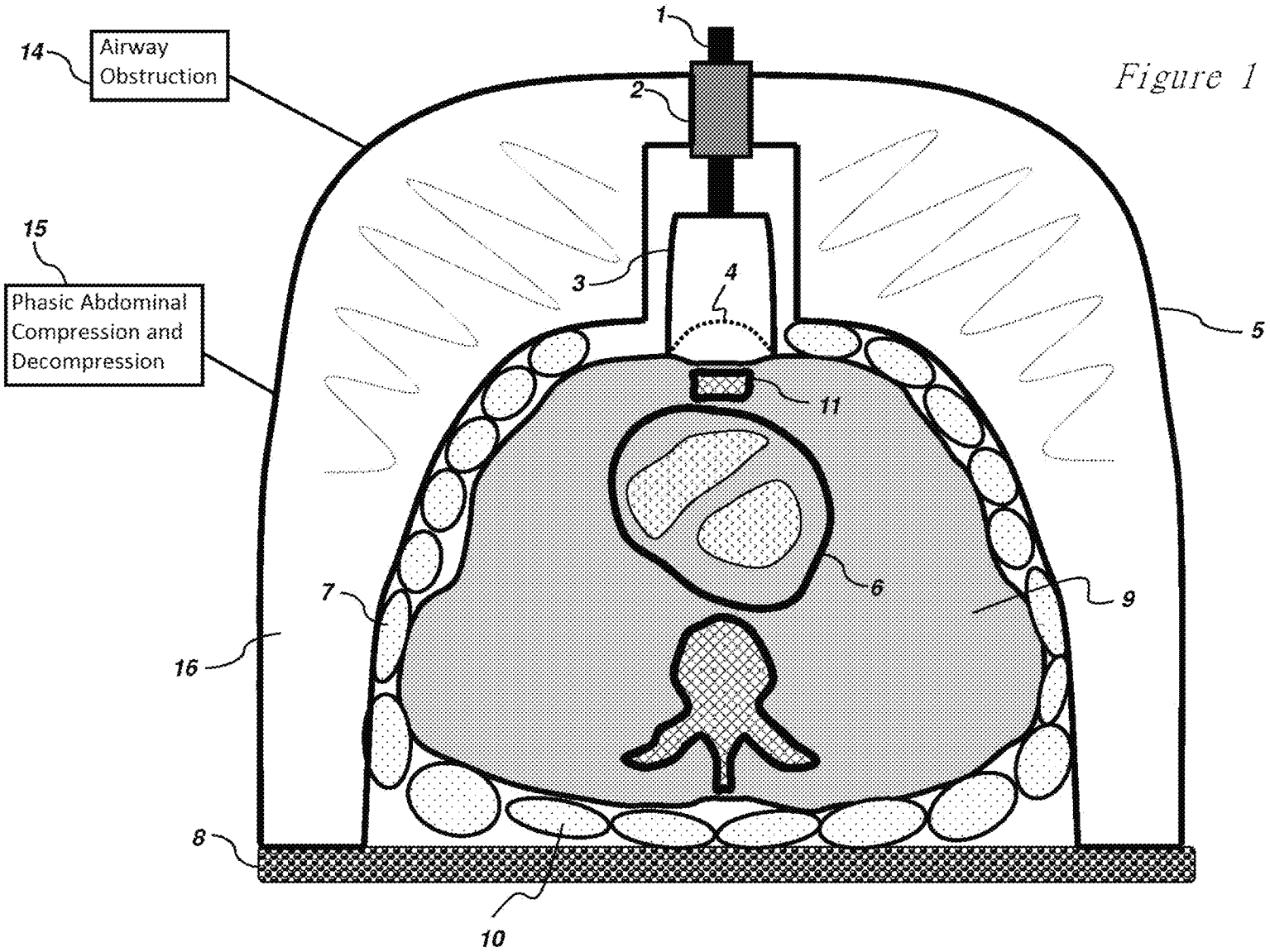
FIG. 1: Cross section of patient, gantry, anteroposterior compression mechanism, multi-bladder pneumatic circumferential constriction mechanism and backboard.
Figure 2:
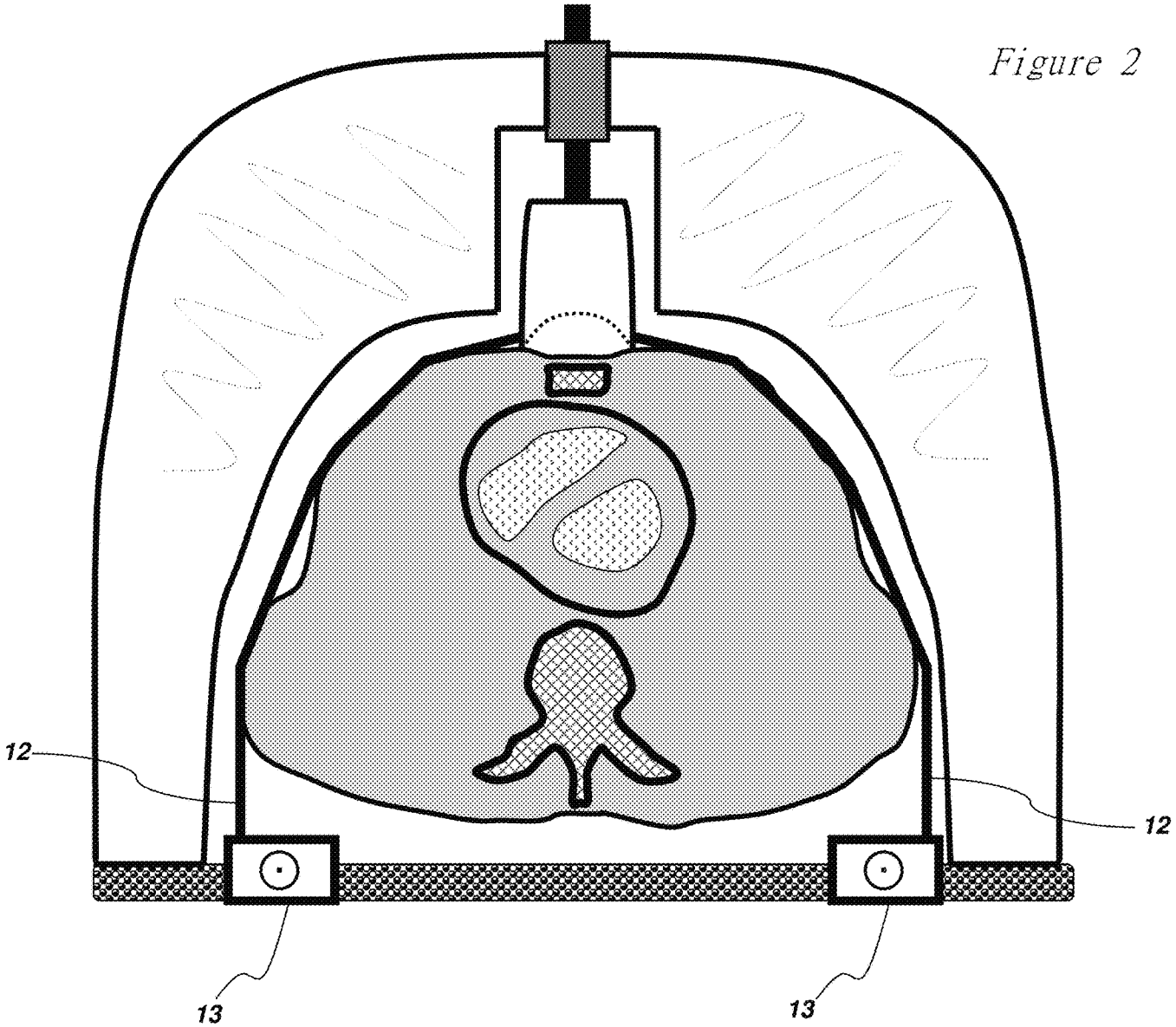
FIG. 2: Cross section of patient, gantry, anteroposterior compression mechanism, belt-band circumferential constriction mechanism, roller motors, and backboard.

The present disclosure is for a system, method, or device intended generally to improve hemodynamics and clinical outcome of patients suffering cardiac arrest, or other low-flow states, by providing CPR that is a combination of circumferential constriction and anteroposterior compression.

It is anticipated that the system would be comprised of multiple components.

A practitioner of ordinary skill in the art, once taught the invention, would appreciate that a preferred, but not limiting, implementation of the method might include:

1. A backboard of sorts 8 to maintain the patient's chest 9 in the optimal configuration with respect to the other components.
2. A piston like device 1, 2, 3 for provision of anteroposterior compression of the patient's chest.
3. A mechanism to attach the piston 3 to the patient's chest 9 for provision of forceful decompression 3, 4. This may be a suction cup or similar device.
4. A structural gantry or arch 5 anterior to or above the patient for holding the piston in position.
5. A circumferential, or semi-circumferential band 12 or pneumatic bladder or bladders 7, 10 for provision of circumferential constriction.
6. A method or methods to provide force or energy to the components that provide anteroposterior compression and circumferential constriction, both for the piston mechanism 2 and the circumferential mechanism 13.

There are components of the invention that, while sufficient, are interchangeable within the context of the invention. A practitioner skilled in the art would know which specific embodiments of these components to utilize in optimizing performance of the invention.

For purposes of illustration and not limitation, a practitioner of ordinary skill in the art would, once taught the invention, be able to construct a particular preferred embodiment composed additionally of:

A hinged backboard 8 capable of changing the geometric relationship or relationships between the head, patient's chest 9, abdomen and extremities.

A section of circumferential pneumatic constrictor may be applied to a portion of the backboard next to the posterior aspect of the patient's chest 10.

The gantry may be adjustable as to shape, so as to maximize the application and effectiveness of the pneumatic constrictor function with respect to the patient's chest. The gantry may be adjustable as to location over the patient such that the location and vector of the anteroposterior compression mechanism.

Adjustable vertical lateral struts on either side of the patient's chest, each with a section of circumferential pneumatic constrictor between the strut and the patient's lateral chest. This may be adjustable as to shape and location, so as to maximize the application and effectiveness of the pneumatic constrictor function chamber to the patient's chest.

A band device 12 capable of wrapping around the patient's anterior and lateral chest and contributing to both anteroposterior compression and circumferential constriction. A section of circumferential pneumatic constrictor system might be applied to a portion of the band so as to further enhance efficacy. This may be adjustable as to shape, so as to maximize the application and effectiveness of the pneumatic constrictor function chamber to the patient's chest. The band itself 12 may be attached to a motor 13 or mechanical device, such that it's length may be forcibly shortened to create chest constriction.

A piston component 3 capable of anteroposterior compression of the chest. This would be attached a motor 2, mechanical or pneumatic device at a point sagittal and centrifugal to the patient, most likely above the mid-anterior chest. The attachment to the gantry 5 and the gantry itself may be adjustable so as to allow change in the vector force of the piston. The patient side of the piston would be capable of attachment to the patient's chest such that the piston could apply upward decompressive force, so called active decompression. This could be accomplished by a suction cup or adhesive component 3, 4.

A mechanical system capable of sending force to the constricting band 12, 13 and piston 1, 3.

A pneumatic system capable of sending inflation-deflation to the chambers of the pneumatic circumferential constricting system 7.

A feedback control component capable of utilizing indicators of tissue perfusion and varying the parameters of the compression and constricting systems so as to improve tissue perfusion and the probability of successful resuscitation.

A control component capable of varying the force or timing of chest compression or constriction so as to increase the likelihood that electrical defibrillation will result in return of spontaneous circulation.

A component capable of providing electrical defibrillation without stopping chest compression or constriction, and at a specific time in the chest compression or constriction cycle.

A particular refinement to improve the efficacy of the system would be enclosure of the pneumatic bladder or bladders within a three sided gantry. The bladder or bladders would incorporate an accordion like mechanism such that the volume has significant capacity to expand. The sidewalls of the gantry would be adjusted to minimize the open space between the gantry and the patient's chest. A practitioner with ordinary skill wound know that the volume and stiffness of the pneumatic bladder, characteristics of the accordion sides and the degree of friction between the sides of the bladder and the adjustable sides of the gantry 5 would determine the force and speed of the circumferential constriction mechanism.

An additional particular refinement would be integration of the anteroposterior compression-decompression piston 3 and the gantry portions 7 of the circumferential constriction mechanism. This integration may be within the gantry structure.

The construction of the attachment capability of active decompression mechanism may be by means of a flexible diaphragm 4 within a hardened hemisphere or bell-like structure 3. This would allow it to be a component of, and functionally contribute to, both the active decompression and the circumferential constriction mechanisms. Application of negative pressure above the diaphragm would engage the attachment-adhesive capability for active decompression. Application of positive pressure above the diaphragm would engage additional compression to the mid-anterior chest, contributing to anteroposterior compression.

Further, a practitioner of ordinary skill in the art would, once taught the invention, further understand that:

1. It is a combination of circumferential constriction and anteroposterior compression of the chest, with or without active decompression of the chest. And that the efficacy of the method may be further enhanced by providing full or partial obstruction 14 of the airway during a fixed portion of the chest compression cycle.
2. In certain embodiments, the component performing anteroposterior compression of the chest is attached to the component providing circumferential constriction.
3. In certain embodiments, the mechanism providing force to the circumferential constricting band may altered and adjusted such that the force is applied unevenly with respect to the chest. Portions of the chest whose constriction is associated with greater positive impact on blood flow would receive greater force and constriction. In specific embodiments this can be achieved by and independent mechanism between the band and the patient.
4. In certain embodiments, the circumferential constriction and anteroposterior compression of the chest are in a fixed phasic relationship with indicators of residual cardiac mechanical or electrical activity.
5. In certain embodiments, the on-off sequence of circumferential constriction and anteroposterior compression may be adjusted to additionally improve efficacy. In one embodiment the circumferential constriction occurs before the anteroposterior compression while in another the reverse occurs.
6. In certain embodiments, the efficacy of circumferential constriction and anteroposterior compression of the chest are augmented by administration of pressor drugs.
7. In certain embodiments, the efficacy of circumferential constriction and anteroposterior compression of the chest are augmented by simultaneous or phasic abdominal binding or abdominal compression.
8. In certain embodiments, the mechanical or pneumatic force for circumferential constriction or anteroposterior compression of the chest may be provided by electrical, mechanical or pneumatic subsystems alone or in combination.
9. In certain embodiments, the circumferential constriction is provided by a band that has inflatable pneumatic chambers on all, or portion, of its inner circumference.
10. In certain embodiments, a portion of the circumferential constriction mechanism is applied to the backboard. Portions of the pneumatic bladder between the backboard and the patient may inflate simultaneously with the anteroposterior compression piston mechanism so as to enhance its efficacy.
11. In certain embodiments, a portion of the circumferential constriction is provided by inflation of pneumatic chambers applied to adjustable vertical side posts 16 connected to the backboard on either side of the patient. These may inflate before the anteroposterior compression is initiated so as to stabilize the chest.
12. In certain embodiments, the component providing anteroposterior compression of the chest also provides force to the anterior portion of a circumferential band.
13. In certain embodiments, the system includes a component capable of sensing a biomarker indicative of system efficacy. Said biomarker may control the on-off sequencing of the other mechanisms.

14. In certain embodiments, the efficacy of the system is augmented by use of a feedback mechanism to control the timing and force of the circumferential constriction and anteroposterior compression of the chest.
15. In certain embodiments, the anteroposterior compression or circumferential constriction mechanism are adjustable in shape or configuration such that they match the shape of the chest more accurately.
16. In certain embodiments, the efficacy of the system is augmented by use of a feedback mechanism that adjusts the location or vector of the anteroposterior compressive mechanism.
17. In certain embodiments, the mechanism providing anteroposterior compression applies greater force and displacement to the compression of the mid-anterior chest compared to the force and distance applied to the remainder of the chest by the circumferential constriction mechanism.
18. In certain embodiments, the system includes a component capable of providing electrical defibrillation without stopping chest compression or constriction. The positive and negative leads for this component may be applied to the patient side of the piston or circumferential constriction band. Multiple leads allows simultaneous defibrillation in multiple vectors.
19. In certain embodiments, the system includes a component capable of providing electrical defibrillation at a specific time in the chest compression or constriction cycle.
20. In certain embodiments, the system includes a component capable of varying the force or timing of chest compression or constriction so as to increase the likelihood that electrical defibrillation will result in return of spontaneous circulation.
21. In certain embodiments, the system includes a hinged backboard capable of changing the geometric relationship or relationships between the head, chest, abdomen and extremities.
22. In certain embodiments, the system includes adjustable lateral struts on either side of the patient's chest, each with a section of the circumferential pneumatic constrictor between the strut and the patient's lateral chest. This is moldable as to shape and adjustable as to location.
23. In certain embodiments, the mechanism providing anteroposterior compression is attached to a gantry over the patient. Said gantry opens such that the patient may be placed on the backboard. Closing the gantry also applies, and mechanically engages, the circumferential constriction mechanism.
24. In certain embodiments, the pneumatic bladder or bladders are enclosed within a hollow three sided gantry. The bladder or bladders are within the gantry and are accordion-like mechanism such that the volume has significant capacity to expand and compress the patient's chest. The sidewalls of the gantry would be adjustable so as to minimize the open space between their ends and the patient's chest.
25. In certain embodiments, the anteroposterior compression-decompression piston and the gantry portions of the circumferential constriction mechanism are integrated within the gantry.
26. In certain embodiments, there are force sensors applied to the patient side surfaces of the anteroposterior compression-decompression piston and the circumferential constriction mechanism. Signals from these sensors are used to adjust the force of the mechanisms.
27. In certain embodiments, the attachment capability of the active decompression mechanism is achieved by means of a flexible diaphragm within a hardened hemispheric structure. Application of negative pressure above the diaphragm would engage the attachment capability for active decompression. Application of positive pressure above the diaphragm would create additional compression to the mid-anterior chest.
28. In certain embodiments, there is an additional mechanism for phasic compression 15 of the abdomen.
29. In certain embodiments, the structure holding the anteroposterior compression mechanism can be moved with respect to the patient's chest such that the location and vector of force is changed.
30. In certain embodiments, an additional component may provide electrical defibrillation at a specific and optimal time in the chest compression constriction cycle without stopping chest compression or constriction.
31. In certain embodiments, the mechanism providing anteroposterior compression applies greater force and distance to the compression of the mid-anterior chest compared to the force and distance applied to the remainder of the chest circumference by the circumferential constriction mechanism.
32. In certain embodiments, the anteroposterior compression or circumferential constriction mechanism are adjustable in shape or configuration such that the match the shape of the chest more accurately.
33. In certain embodiments, the anteroposterior compression-decompression piston and the gantry portions of the circumferential constriction mechanism are integrated within the gantry.
34. In certain embodiments, the circumferential constriction mechanism is a belt. Said belt is attached at one end to the side of the anteroposterior compression mechanism and at the other end to motors on either side of the patient and incorporated in the backboard.

Usefulness of the Disclosed Invention

Once it is understood and appreciated that the invention disclosed herein is for a method to improve CPR hemodynamics and the clinical outcome of patients suffering cardiac arrest, the usefulness will be manifest to anyone with ordinary skill in the art.

Non-Obviousness

The non-obviousness of the invention herein disclose is clear from the complete absence of its appreciation or discussion in the medical literature. Additionally, a number of large commercial enterprises produce devices for mechanical CPR; despite extensive research and development enterprises, none of these companies have disclosed or developed methods or systems such as disclosed herein.

Modifications

It will be understood that many changes in the details, materials, steps and arrangements of elements, which have been herein described and illustrated in order to explain the nature of the invention, may be made by those skilled in the art without departing from the scope of the present invention. Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

Other Publications Incorporated in the Current Application by Reference

REFERENCE LIST

*CARDIAC ARREST—The Science and Practice of Resuscitation Medicine.* Ed. N. A. Paradis, H. R. Halperin, and R. M. Nowak. 1 ed. Baltimore: Williams & Wilkins, 96 A.D.

Aufderheide, T. P., et al. "Clinical evaluation of an inspiratory impedance threshold device during standard cardiopulmonary resuscitation in patients with out-of-hospital cardiac arrest." *Crit Care Med.* 33.4 (2005): 734-40.

Barkalow, B. H. "Comparison of miniaturized pneumatic chest compressor to Thumper." *Resuscitation* 79.3 (2008): 509.

Cohen, T. J., et al. "Active compression-decompression. A new method of cardiopulmonary resuscitation. Cardiopulmonary Resuscitation Working Group [see comments]." *JAMA* 267 (1992): 2916-23.

Halperin, H. R., et al. "Cardiopulmonary resuscitation with a novel chest compression device in a porcine model of cardiac arrest: improved hemodynamics and mechanisms." *J. Am. Coll. Cardiol.* 44.11 (2004): 2214-20.

Halperin, H. R., et al. "A preliminary study of cardiopulmonary resuscitation by circumferential compression of the chest with use of a pneumatic vest." *N. Engl. J. Med.* 329 (1993): 762-68.

Kouwenhoven, W. B., J. R. Jude, and G. G. Knickerbocker. "Closed Chest Cardiac Massage." *JAMA* 173 (1960): 1064-67.

McDonald, J. L. "Systolic and mean arterial pressures during manual and mechanical CPR in humans." *Ann Emerg. Med* 11 (1982): 292-95.

Niemann, J. T., et al. "Cough-CPR: documentation of systemic perfusion in man and in an experimental model: a "window: to the mechanism of blood flow in external CPR." *Crit Care. Med* 8 (1980): 141-46.

Ong, M. E., et al. "Use of an automated, load-distributing band chest compression device for out-of-hospital cardiac arrest resuscitation." *JAMA* 295.22 (2006): 2629-37.

Paradis, N. A. "Is this the next step for CPR?" *Am. J. Emerg. Med.* 34.1 (2016): 97-99.

Paradis, N. A., et al. "Coronary perfusion pressure during external chest compression in pseudo-EMD, comparison of systolic versus diastolic synchronization." *Resuscitation* 83.10 (2012): 1287-91.

Plaisance, P., K. G. Lurie, and D. Payen. "Inspiratory impedance during active compression-decompression cardiopulmonary resuscitation: a randomized evaluation in patients in cardiac arrest." *Circulation* 101.9 (2000): 989-94.

Plaisance, P., et al. "Use of an inspiratory impedance threshold device on a facemask and endotracheal tube to reduce intrathoracic pressures during the decompression phase of active compression-decompression cardiopulmonary resuscitation." *Crit Care Med.* 33.5 (2005): 990-94.

Ralston, S. H., C. F. Babbs, and M. J. Niebauer. "Cardiopulmonary resuscitation with interposed abdominal compression in dogs." *Anesth. Analg.* 61 (1982): 645-51.

Rudikoff, M. T., et al. "Mechanisms of Blood Flow During Cardiopulmonary Resuscitation." *Circulation* 61 (1980): 345-52.

What is claimed is:

1. A method to improve hemodynamics and clinical outcome of patients suffering cardiac arrest, or other low-flow states, the method comprising:

providing cardiopulmonary resuscitation that is a combination of providing circumferential constriction and providing anteroposterior compression decompression of a chest of a patient, and incorporating feedback from a feedback mechanism to automatically control the timing of the circumferential constriction and the anteroposterior compression decompression of the chest, and wherein the anteroposterior compression and the circumferential constriction occur together, then the circumferential constriction reaches its full constriction before the anteroposterior compression decompression reaches its full compression, then the anteroposterior compression reaches its full compression after the circumferential constriction has reached its full constriction, said anteroposterior compression ultimately being closer to the center of the patient's chest.

2. The method according to claim 1 wherein providing anteroposterior compression decompression includes attaching an anteroposterior compression decompression mechanism to the chest and providing forceful decompression of the chest.

3. The method according to claim 1 further comprising temporary full or partial obstruction of an airway during a portion of a chest compression cycle.

4. The method according to claim 2 further comprising temporary full or partial obstruction of an airway during a portion of a chest compression cycle.

5. The method according to claim 2 wherein forces applied to the chest by the anteroposterior compression decompression mechanism, a circumferential constriction mechanism, and an active decompression mechanism are in a ratio of 1:2:1.

6. The method according to claim 1 wherein the circumferential constriction and anteroposterior compression decompressions are simultaneous.

7. The method according to claim 1 wherein the circumferential constriction and anteroposterior compression decompression are mechanisms having a fixed phasic relationship that is not simultaneous, wherein the fixed phasic relationship is in phase with indicators of residual cardiac mechanical or electrical activity.

8. The method according to claim 1 wherein circumferential constriction is provided by a mechanism selected from the group consisting of: inflation of a pneumatic device, inflation of pneumatic chamber, inflation of a series of pneumatic chambers, and a band that has inflatable pneumatic chambers on all or portion of its inner circumference.

9. The method according to claim 1 further comprising phasic abdominal compression and decompression in phase with the anteroposterior compression decompression.

10. The method according to claim 1 wherein a portion of a circumferential constriction mechanism is applied to vertical posts on both sides of the patient.

11. The method according to claim 1 further comprising incorporating feedback from the feedback mechanism to automatically control individual force contributions of the circumferential constriction and anteroposterior compression decompression.

12. The method according to claim 1 wherein one or more pneumatic bladders are enclosed within a three sided gantry, the bladder or bladders being an accordion mechanism of expandable volume, and the sidewalls of the gantry adjustable with respect to the patient's chest.

13. The method according to claim 2 wherein a flexible diaphragm within a hardened bell structure is on a patient side of an anteroposterior compression mechanism, and application of positive pressure above said diaphragm by a motor operatively connected to the hardened bell structure augments compression and circumferential constriction and application of negative pressure augments sternal decompression.

14. The method according to claim 1 further comprising adjusting a pattern of the circumferential constriction such that it is not uniform and provides greater constriction to one area of the chest than another.

15. The method according to claim 1 wherein compression and constriction mechanisms are contained within a gantry over the patient and wherein said gantry opens such that the patient may be placed on a backboard, and closing the gantry applies and engages the compression and constriction mechanisms.

16. The method according to claim 2 wherein an attachment capability of active decompression mechanism is a flexible diaphragm within a hardened hemispheric structure, and application of negative pressure above the diaphragm engages the attachment capability during active decompression.

17. The method according to claim 1 wherein portions of a pneumatic bladder that are between a backboard and the patient inflate under the patient simultaneously with the anteroposterior compression, thereby pushing the patient upwards into an anteroposterior compression mechanism, and wherein the pneumatic bladder is not located between the patient and the anteroposterior compression mechanism.

18. A method to improve hemodynamics and clinical outcome of patients suffering cardiac arrest, or other low-flow states, the method comprising:

providing cardiopulmonary resuscitation that is a combination of providing circumferential constriction and providing anteroposterior compression decompression of a chest of a patient, wherein the anteroposterior compression and the circumferential constriction occur together, then the circumferential constriction mechanism reaches its full constriction before the anteroposterior compression decompression reaches its full compression, then the anteroposterior compression reaches its full compression after the circumferential constriction mechanism has reached its full constriction, said anteroposterior compression ultimately being closer to the center of the patient's chest.

19. A method to improve hemodynamics and clinical outcome of patients suffering cardiac arrest, or other low-flow states, the method comprising:

providing cardiopulmonary resuscitation that is a combination of providing circumferential constriction and providing anteroposterior compression decompression of a chest of a patient, and incorporating feedback from a feedback mechanism to automatically control the timing of the circumferential constriction and the anteroposterior compression decompression of the chest, and wherein portions of a pneumatic bladder that are between a backboard and the patient inflate under the patient simultaneously with the anteroposterior compression, thereby pushing the patient upwards into an anteroposterior compression mechanism, and wherein the pneumatic bladder is not located between the patient and the anteroposterior compression mechanism.

* * * * *